United States Patent [19]

Ito et al.

[11] Patent Number: 4,494,511

[45] Date of Patent: Jan. 22, 1985

[54] FUEL INJECTION SYSTEM FOR INTERNAL COMBUSTION ENGINES

[75] Inventors: Osamu Ito, Toyota; Nobuhito Hobo, Inuyama; Yoshihiko Tsuzuki, Anjo; Yutaka Suzuki, Nishio; Takashi Hasegawa, Kariya, all of Japan

[73] Assignee: Nippondenso Co., Ltd., Kariya, Japan

[21] Appl. No.: 452,337

[22] Filed: Dec. 22, 1982

Related U.S. Application Data

[63] Continuation of Ser. No. 244,911, Mar. 18, 1981, abandoned, which is a continuation of Ser. No. 9,360, Feb. 5, 1979, abandoned.

[30] Foreign Application Priority Data

Feb. 14, 1978 [JP] Japan ..... 53-16130
Mar. 9, 1978 [JP] Japan ..... 53-27077

[51] Int. Cl.[3] ..... F02M 39/00; F02D 1/04

[52] U.S. Cl. ..... 123/463; 123/478; 123/470; 261/69 A

[58] Field of Search ..... 123/470, 469, 471, 452, 123/463, 478, 482, 472, 453, 454, 455, 445; 261/69 A, 69 R

[56] References Cited

U.S. PATENT DOCUMENTS 3,610,213 10/1971 Gianini ..... 123/463
3,807,710 4/1974 Bergamini ..... 261/69 A
3,861,366 1/1975 Masaki ..... 123/438
3,868,936 3/1975 Rivere ..... 123/445
3,910,291 10/1975 Fujisawa ..... 123/463
3,916,856 11/1975 Jackson ..... 123/506
4,023,357 5/1977 Masaki ..... 123/589
4,083,342 4/1978 Bertling ..... 123/589
4,096,211 6/1978 Rameau ..... 123/445
4,122,811 10/1978 Bowler ..... 123/440
4,153,014 5/1979 Sweet ..... 123/478
4,161,499 7/1979 Floroff ..... 123/510

OTHER PUBLICATIONS

I. Gorille, N. Rittmannsberger and P. Werner, "Bosch Electronic Fuel Injection with Closed Loop Control", *Automotive Electronics II,* Society of Automotive Engineers, Inc., Warrendale, Pa., Feb. 1975.

*Primary Examiner*—Charles J. Myhre
*Assistant Examiner*—Carl Stuart Miller
*Attorney, Agent, or Firm*—Cushman, Darby & Cushman

[57] ABSTRACT

In a fuel injection system which electrically controls an amount of pressurized fuel supplied to an internal combustion engine, an electromagnetic valve which opens to inject the pressurized fuel is disposed at an upstream of a throttle valve in an intake pipe so that a group of cylinders of the engine is supplied with fuel therefrom. A pressure regulator is provided to regulate a pressure of the pressurized fuel in proportion to an intake pressure present at a downstream of the throttle valve.

19 Claims, 6 Drawing Figures

FUEL INJECTION SYSTEM FOR INTERNAL COMBUSTION ENGINES

This is a continuation of application Ser. No. 244,911, now abandoned, filed Mar. 18, 1981 which is a Rule 60 continuation of Ser. No. 9,360, filed Feb. 5, 1979, also abandonded.

BACKGROUND OF THE INVENTION

The present invention relates to a fuel injection system for an internal combustion engine, and more particularly it relates to a fuel injection system in which an amount of fuel supplied to an internal combustion engine is electrically controlled.

In a fuel metering system for an internal combustion engine, it is well known that an electromagnetic valve which opens to inject a pressurized fuel is disposed in each of a group of intake manifolds communicating with respective cylinders of the engine and that a pressure regulator is provided to regulate a pressure of the pressurized fuel at a constant value. The electromagnetic valve is activated in synchronized relation with the rotation of a crankshaft of the engine and an opening interval of time $\tau(\tau=K'\cdot Qa/N$ where K': constant) is determined by an electric control circuit in response to a rotation speed N of the crankshaft and an amount of air Qa sucked through an intake pipe communicating with the intake manifolds. From cost saving spirits, this conventional fuel injection system is not desirable, since as many electromagnetic valves as the number of cylinders are necessitated.

To provide a fuel injection system which is low in manufacturing cost, it is suggested that the electromagnetic valve is disposed singly in the intake pipe and that the electromagnetic valve is activated by the electric control circuit at least as many times as the number of suction strokes of the engine. According to this suggestion, an allowable maximum opening interval of time $\tau_M$ of the electromagnetic valve under the maximum rotation speed (6,000 r.p.m.) of the crankshaft is determined as follows on an assumption that the engine is in a four-cylinder four stroke type.

$$\tau_M=1/((6{,}000/60)\cdot(\tfrac{1}{2})\cdot 4)=0.005 \text{ (sec.)}$$

Since the maximum opening interval of time of the electromagnetic valve is required in general to be four times longer than the minimum opening interval of time of the electromagnetic valve,. the minimum opening interval of time $\tau_m$ at the maximum rotation speed (6,000 r.p.m.) is limited as follows.

$$\tau_m=\tau_M/4=0.00125 \text{ (sec.)}$$

Since the electromagnetic valve has a response delay time, generally some 0.001 (sec.), from closing to opening, the response delay time is not negligible relative to the minimum opening interval of time $\tau_m$. This means that a precise fuel metering cannot be performed by the electromagnetic valve.

SUMMARY OF THE INVENTION

It is therefore a primary object of the present invention to provide an improved fuel injection system which is low in manufacturing cost and precise in fuel metering operation.

According to the present invention, an electromagnetic valve activated at least as many times as the number of suction strokes in an engine is disposed upstream of a throttle valve in an intake pipe and a pressure regulator is provide to regulate a pressure of pressurized fuel supplied to the electromagnetic valve in proportion to an intake pressure present at a position downstream of the throttle valve. This arrangement is effective to keep the response delay time of the electromagnetic valve negligible relative to the minimum opening interval of time of the electromagnetic valve in the following manner.

Assuming that the electromagnetic valve is activated as many times as the number of suction strokes in the engine, an amount of fuel $q_F$ supplied to the engine in each opening of the electromagnetic valve is determined as follows:

$$q_F = k_1 \cdot \sqrt{P_F} \cdot \tau, \tag{1}$$

where $k_1$ represents a constant, $P_F$ represents a difference in pressures of fuel present at an inlet and outlet of the electromagnetic valve, and $\tau$ represents an opening interval of time of the electromagnetic valve. The amount of fuel $q_F$ may be expressed as follows:

$$q_F=q_a/M \tag{2}$$

where $q_a$ represents an amount of air sucked into each cylinders in each suction stroke and M represent an airfuel ratio of mixture. From these equations (1) and (2), the opening interval of time $\tau$ is expressed as follows.

$$\tau = \frac{q_a}{k_1 \cdot M \cdot \sqrt{P_F}} \tag{3}$$

The amount of air $q_a$ sucked into each cylinder is expressed $Q_a=k_2\cdot(Q_a/N)$ ($k_2$:constant), and an intake pressure $P_I$ present at the downstream of the throttle valve is expressed as $P_I=k\cdot(Q_a/N)$ (k: constant) in an absolute pressure notation. Further, the pressure difference $P_F$ is expressed as $P_F=k_3\cdot P_I+P_O-P$, where $k_3$ represents a constant, $P_O$ represents a constant, $P_O$ represents in absolute pressure notation an initial pressure of fuel supplied to the inlet of the electromagnetic valve, and P represents in absolute pressure notation a pressure present at the outlet of the electromagnetic valve. In view of these equations, the opening interval of time $\tau$ expressed by the equation (3) is expressed as follows:

$$\tau = \frac{q_a}{k_1 \cdot M \cdot \sqrt{k_3 \cdot P_I + P_0 - P}} = \frac{k \cdot \sqrt{\frac{Q_a}{N}}}{M \cdot \sqrt{1 + \frac{P_0 - P}{k \cdot k_3} \cdot \frac{N}{Q_a}}}, \tag{4}$$

where K represent a constant. Since the amount of air $q_a$ is expressed as $q_a=k_4\cdot P_I$ ($k_4$:consant), the equation (4) may be expressed as follows in an alternative form:

$$\tau = \frac{K_1 \cdot \sqrt{P_I}}{M \cdot \sqrt{1 + \frac{P_0 - P}{k_2 \cdot P_I}}}, \quad (5)$$

where $K_1$ and $K_2$ represnet constants.

It should be noticed in the equations (4) and (5) that, since the initial pressure $P_O$ of the pressurized fuel is constant and the pressure P present at the throttle upstream in substantially equal the atmospheric pressure, the opening interval of time $\tau$ changes in response to the intake pressure $P_I$ present downstream of the throttle or the quotient $Q_a/N$ between the amount of air $Q_a$ and the rotation speed N. That is, the opening interval of time $\tau$ is required to change in proportion to the square root value $\sqrt{P_I}$ or $\sqrt{Q_a/N}$. This means that, although the maximum value of the intake pressure $P_I$ or the quotient $Q_a/N$ is generally four times larger than the minimum value, the required range of change in the opening interval of time $\tau$ may be smaller than the range of change in the intake pressure $P_I$ or the quotient $Q_a/N$. Therefore, the minimum opening interval of time of the electromagnetic valve may be lengthened to keep the response delay time of the electromagnetic valve more negligible.

DETAILED DESCRIPTION OF THE PREFERRED EMBODIMENTS

Figure 1:
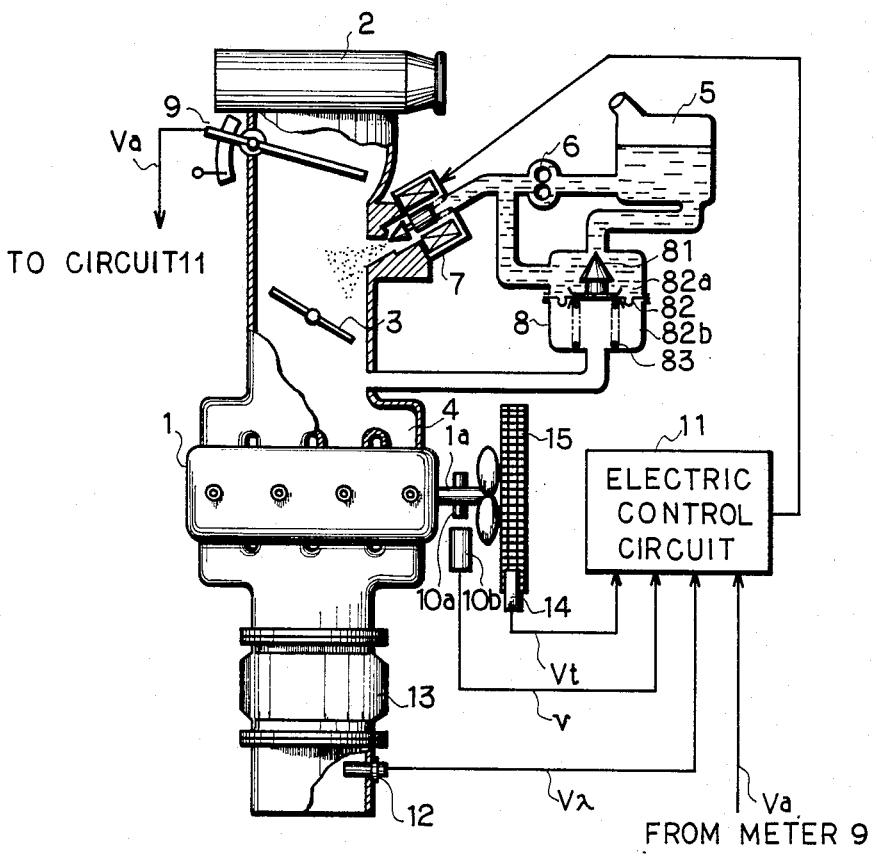
FIG. 1 is a schematic diagram showing a first embodiment of the present invention.

Referring first to FIG. 1 in which a first embodiment of a fuel injection system according to the present invention is shown, numeral 1 designates a multi-cylinder engine which sucks air into each cylinder during the suction stroke. The air is sucked through an air filter 2, a throttle valve 3 and an intake manifold 4. Fuel supplied from a fuel reservoir 5 is pressurized by a fuel pump 6 and is supplied to the fuel inlet of an electromagnetic valve 7. The fuel outlet of the electromagnetic valve 7 is disposed at the upstream of the throttle valve 3 provided in an intake pipe of the engine 1. Since the presence decrease in the air filter 2 is negligible, the pressure P present at around the fuel outlet of the electromagnetic valve 7, or at the upstream of the throttle valve 3, is substantially equal to the atmospheric pressure.

The pressure of fuel supplied to the inlet of the electromagnetic valve 7 is regulated by a fuel pressure regulator 8. Pressure regulation in the pressure regulator 8 is performed in response to the intake pressure $P_I$ present at the downstream of the throttle valve 3. The pressure regulator 8 is provided with a flexible diaphragm 82 which partitions the regulator 8 into a fuel chamber 82*a* and a vacuum chamber 82*b* and moves a needle valve 81 for bypassing the pressurized fuel from the fuel pump 6 to the fuel reservoir 5. The fuel chamber 82*a* provided at one side of the diaphragm 82 receives the pressurized fuel which acts upon the diaphragm 82, and the vacuum chamber 82*b* provided at the other side of the diaphragm 82 receives the intake pressure $P_I$ present downstream of the throttle valve 3. In the pressure regulator 8, a spring 83 is provided in the vacuum chamber 82*b* to bias the needle valve 81 to close. Assuming that the atmospheric pressure is introduced into the vacuum chamber 82*b* the spring 83 determines the initial pressure $P_O$ of fuel supplied to the electromagnetic valve 7. The diaphragm 82 moves to open the valve 81 in response to the intake pressure $P_I$ which is lower than the atmospheric pressure so that the pressured fuel is regulated at a valve which is lower than the initial pressure $P_O$.

For detecting operating conditions of the engine 1, an air flow meter 9 which produces an electric intake air analog voltage $V_a$ indicative of the amount of sucked air and a rotation angle detector 10 which produces an electric angular pulse voltage v indicative of a predetermined angular rotation of a crankshaft 1*a* are provided. flow meter 9 provided upstream of the intake pipe comprises a measuring plate which is disposed in the intake pipe and biased by a biasing spring so that the biased measuring plate moves in response to the flow of sucked air, and a potentiometer associated with the measuring plate for converting the movement of the measuring plate into the analog voltage. Rotation angle detector 10 which produces the pulse voltage v at each suction sroke comprises an inductor 10*a* provided on the crankshaft 1*a* of the engine 1, and an electromagnetic pick-up 10*b* provided to face the inductor 10*a*. With the engine 1 having four cylinders, the pulse voltage v is produced each time the crankshaft 1*a* attains a half rotation. In addition, an oxygen detector 12 which produces an electric ratio voltage $V_\lambda$ indicative of the air-fuel ratio of air-fuel mixture supplied to the engine 1 and a temperature detector 14 which produces electric temperature voltage indicative of the temperature of engine coolant are provided at a downstream of a three-way catalyst 13 and on a radiator 15, respectively. An electric control circuit 11 connected to receive these voltages calculates a required interval of time $\tau$ of the electromagnetic valve 7.

Figure 2:
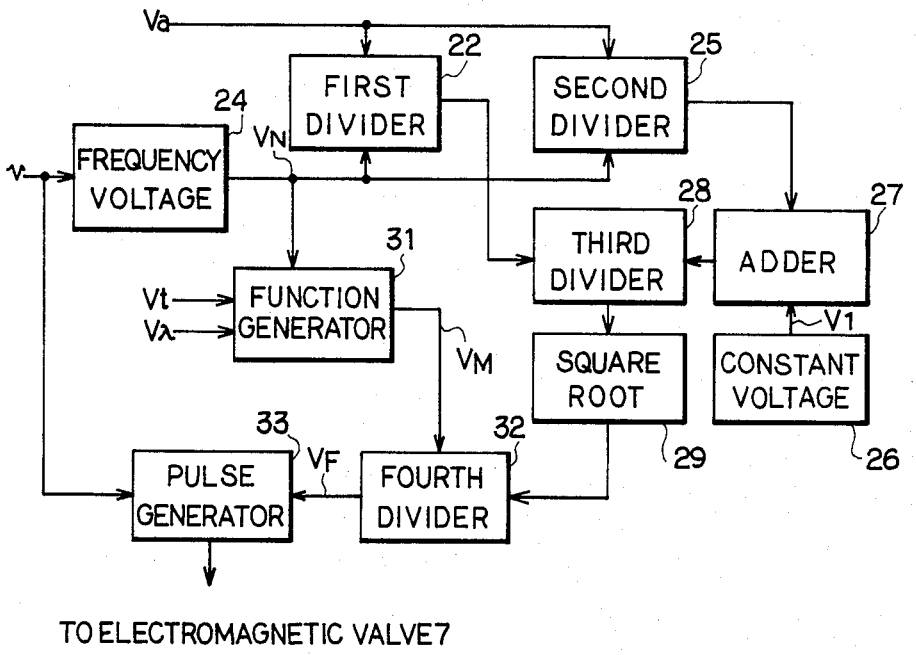
FIG. 2 is an electric wiring diagram of an electric control circuit used in the first embodiment shown in FIG. 1.

Referring next to FIG. 2 in which the electric control circuit 11 is shown in detail, numeral 24 designates a frequency-voltage coverter which converts the number of pulse voltages v produced from the rotation angle detector 10 into an analog rotation voltage $V_N$ indicative of the rotation speed of the crankshaft 1*a*. Numeral 22 designates a first divider which divides the intake air voltage $V_a$ produced from the air flow meter 9 by the rotation voltage $V_N$. Numeral 25 designates a second divider which divides the rotation voltage $V_N$ by the intake air voltage $V_a$ to produce an output voltage indicative of a value $(P_O-P)/k \cdot k_3) \cdot (V_N/V_a)$ $(P_{O-P)/k \cdot k3})$ being constant). Numeral 26 designates a constant voltage generator which produces a constant voltage $V_1$. Numeral 27 designates an adder which adds the constant voltage $V_1$ to the output voltage $(P_O-P)/(k \cdot k_3) \cdot (V_N/V_a)$ of the second divider 25. Numeral 28 designates a third divider which devides the output voltage $V_a/V_N$ of the first divider 22 by the output voltage $(V_1+(P_O-P)/k\cdot k_3))\cdot(V_N/V_a)$ of the adder 27. Numeral 29 designates a square root calculator which calculates a square root value $$\sqrt{(V_a/V_N)/\left(V_1+\frac{P_0-P}{k\cdot k_3}\cdot\frac{V_N}{V_a}\right)}$$

from the output voltage of the third divider 29. Numeral 31 designates a function generator which generates a function voltage $V_M$ proportional to a desired air-fuel mixture ratio M. The rotation speed voltage $V_N$ is applied to the function generator 31 so that the air fuel ratio M may be determined in response to the rotation speed N of the engine 1. In addition, a coolant temperature voltage $V_t$ indicative of the coolant temperature $T_w$ detected by the coolant temperature detector 14 and an oxygen cencentration voltage $V_\lambda$ indicative of the oxygen concentration in exhaust gases may be applied so that the air-fuel ratio M may be determined more precisely as described later. Numeral 32 designates a fourth divider which divides the output voltage of the square root calculator 29 by the air-fuel ratio voltage $V_M$ of the function generator 31 to produce a fuel voltage $$V_F=\frac{K}{K_m}\cdot\sqrt{(V_a/V_N)/\left(V_1+\frac{P_0-P}{k\cdot k_3}\cdot\frac{V_N}{V_a}\right)}\ .$$

This fuel voltage $V_F$ represents in an analog voltage form the opening interval of time $\tau$ obtained in the equation (4) which determines the amount of fuel $q_F$ injected in each operation of the electromagnetic valve 7. Numeral 33 designates a voltage-controlled timer pulse generator which produces the timer pulse voltage having the interval of time T synchronized with the pulse voltage v applied from the rotation angle detector 10. This interval of time T is varied in proportion to the fuel voltage $V_F$ and includes desirably a constant interval corresponding to the response delay time of the electromagnetic valve 7. With this timer pluse voltage being applied to the electromagnetic valve 7, the opening interval of time of the electromagetic valve 7 activated at every suction strokes of the engine 1 is controlled to a value $\tau$ obtained in the equation (4). Model 4450 manufactured by TELEDYNE INC. in U.S.A. may be used as the dividers 23, 25, 28 and 32, and model 4353 manufactured by TELEDYNE INC. in U.S.A. may be used as the square root calculator 29.

Figure 3:
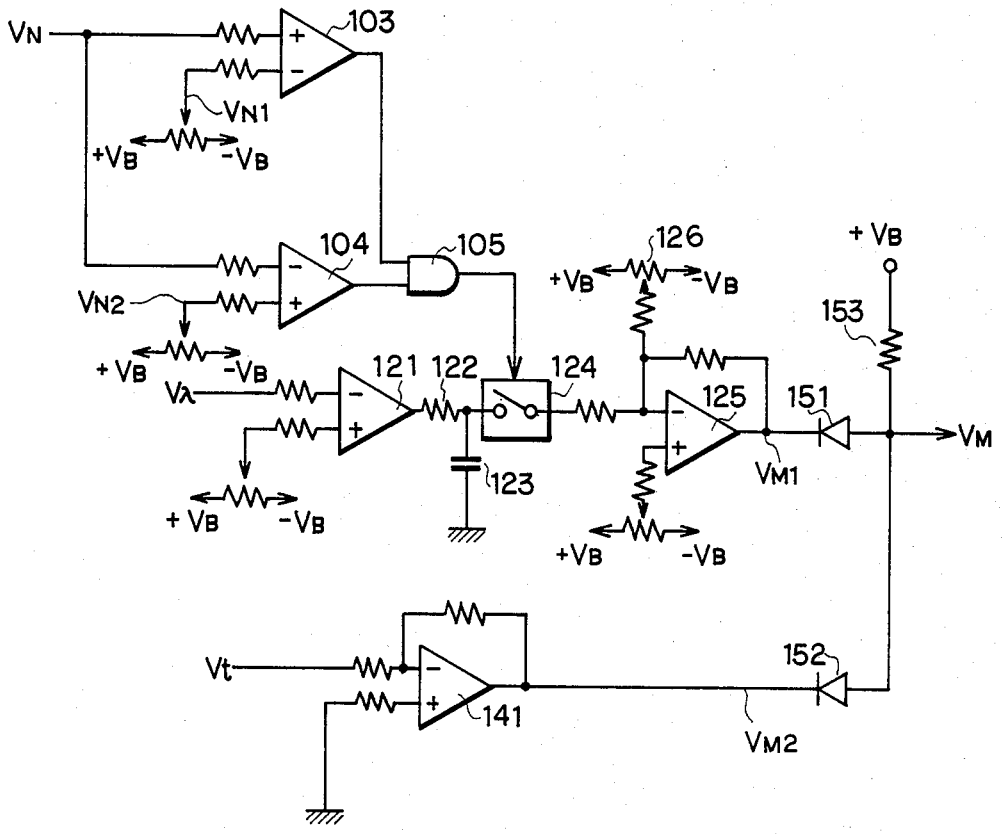
FIG. 3 is an electric wiring diagram of a function generator used in the electric control circuit shown in FIGS. 1 and 2.

The function generator 31 is shown in detail in FIG. 3, in which numerals 103 and 104 designate comparators which produce high level voltage, respectively, when the rotation speed voltage $V_N$ is above a predetermined rotation voltage $V_{N1}$ corresponding to a low rotation speed $N_1$ and is below a predetermined rotation voltage $V_{N2}$ corresponding to a high rotation speed $N_2$. These high level output voltages are applied to an AND gate 105 which responsively closes an analog switch 124. Numeral 121 designates a comparator which discriminates whether the voltage $V^\lambda$ is above or below a predetermined value. The output voltage of the comparator 121 is integrated by an integrator comprising a resistor 122 and a capacitor 123. An integration output voltage is applied to an adder 125 through the analog switch 124. The adder 125 adds a constant bias voltage to the integration output voltage to produce a first air-fuel ratio voltage $V_{M1}$. Accordingly, when the rotation speed N is higher and lower than the speeds $N_1$ and $N_2$, respectively, the analog switch 124 closes and the output voltage $V_{M1}$ of the adder 125 indicates that the air-fuel ratio M of mixture supplied to the engine 1 is to be controlled at the stoichiometric air-fuel ratio. When the rotation speed N is below or above the speed $N_1$ or $N_2$, respectively, the output voltage $V_{M1}$ is determined by a voltage divider 126. The temperature voltage $V_t$ produced from the temperature detector 14 is applied to a differential amplifier 141 which produces a second air-fuel ratio voltage $V_{M2}$. The output voltages $V_{M1}$ and $V_{M2}$ are applied to a low voltage selector comprising two diodes 151 and 152 and a resistor 153. The selector selects lower one of two input voltage $V_{M1}$ and $V_{M2}$.

Figure 4:
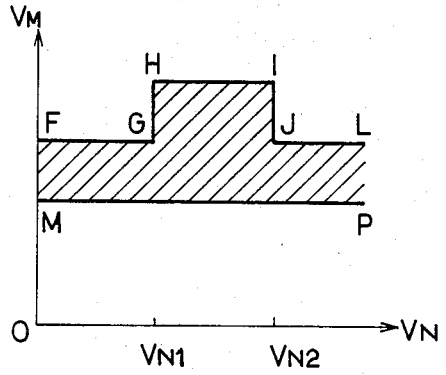
FIG. 4 is a characterized chart showing an input-output characteristic of the function generator shown in FIG. 3.

The function pattern of the air-fuel ratio voltage $V_M$ determined by the above-described function generator 31 is shown in FIG. 4 in which the abscissa and the ordinate represent the rotation voltage $V_N$ and the air-fuel ratio voltage $V_M$, respectively. When the temperature voltage $V_t$ is equal to or above a predetermined value $V_{t0}$ after engine warm-up, the function pattern is determined as shown by the line F-G-H-I-J-L. With $V_t$ being equal to a predetermined value $V_{t1}$ smaller than $V_{t0}$, the function pattern is determined as shown by the line M-P. As the temperature voltage $V_t$ is increased from $V_{t1}$ toward $V_{t0}$, the function pattern M-P moves upward in FIG. 4 so that the air-fuel ratio voltage $V_M$ is modulated within a hatched region in FIG. 4.

Figure 5:
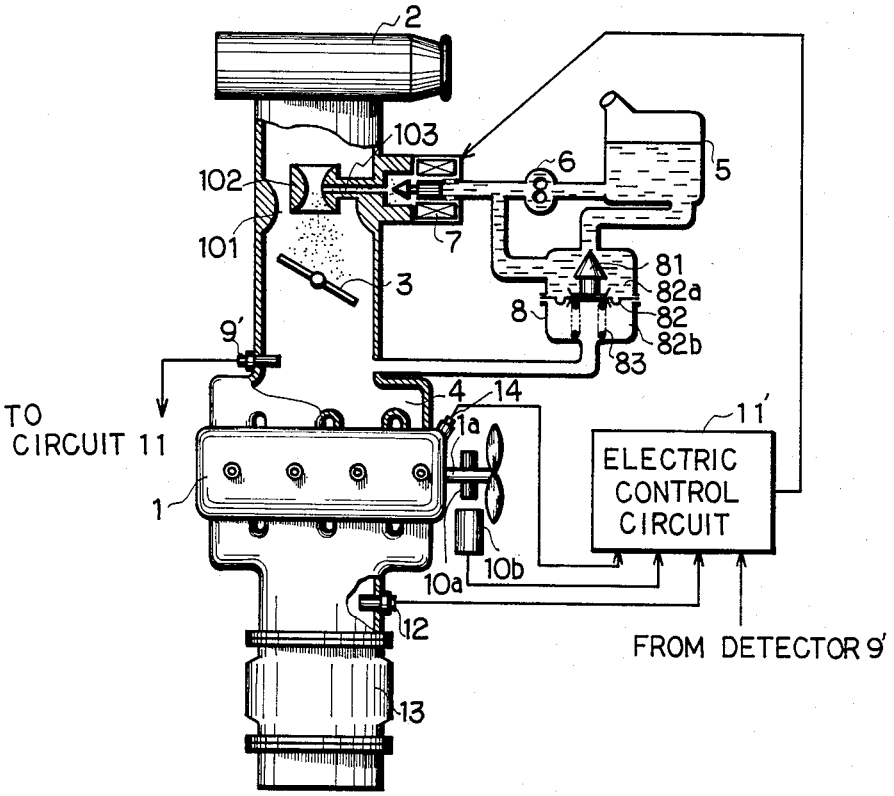
FIG. 5 is a schematic diagram showing a second embodiment of the present invention.

Referring to FIG. 5 in which a second embodiment of the fuel injection system according to the present invention is shown, it should be noted that a venturi portion comprising a large venturi 101 and a small venturi 102 is provided in the intake pipe at the upstream of the throttle valve 3. The fuel outlet of the electromagnetic valve 7 is communicated with the small venturi 102 via a fuel nozzle 103. It should be further noted that an intake pressure detector 9' is disposed at the downstream of the throttle valve 3 to produce an intake pressure voltage $V_p$ applied to an electric control circuit 11' and that the oxygen detector 12 and the temperature detector 14 are disposed upstream of the catalyst 13 and on the engine 1, respectively. The second embodiment other than these is the same as the first embodiment. The electric control circuit 11' which receives the intake pressure voltage $V_p$ from the pressure detector 9' may be designed with ease in view of the first embodiment to calculate the required opening interval of time $\tau$ in response to the intake pressure $P_I$ present at the downstream of the throttle valve 3. Therefore, no further description relating to the control circuit 11' is made.

In the second embodiment, the venturi portion 101 and 102 and the fuel nozzle 103 are effective to atomize the fuel metered by the electromagnetic valve 7 into small particles. When the intake pressure $P_I$ is low due to small opening of the throttle valve 3, the pressure of fuel metered by the electromagnetic valve 7 remains low. Therefore, the fuel is likely to be injected from the fuel nozzle 103 in large particles. However, since the venturi portion is provided where the fuel is injected, the fuel injected is atomized favorably by the air flowing through the venturi portion at comparatively high speeds. When the intake pressure $P_I$ is high due to large opening of the throttle valve, the pressure of fuel metered by the electromagnetic valve 7 is kept high.

Therefore, the fuel injected from the fuel nozzle 103 is atomized into small particles more favorably.

Figure 6:
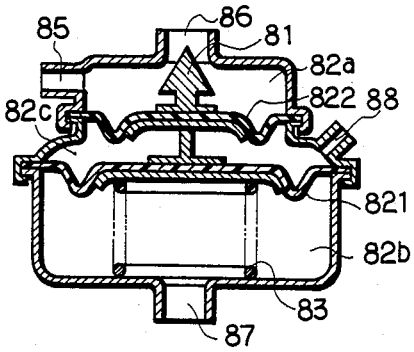
FIG. 6 is a sectional view showing a modification of a pressure regulator used in the first and second embodiments respectively shown in FIGS. 1 and 5.

In the first and second embodiments, it should be noticed that, since the pressure in the vacuum chamber 82*b* of the pressure regulator 8 changes at most from the atmospheric pressure to the minimum intake manifold vacuum pressure, a fuel pressure change larger than one atmosphere may not be obtained with the diaphragm 82 having a fuel pressure receiving area and an intake pressure receiving area equal to each other. To obtain a larger fuel pressure change, the pressure regulator 8 may be modified as shown in FIG. 6. The pressure regulator 8 is provided with two diaphragms 821 and 822 which receive the fuel pressure and the intake vacuum pressure, respectively. With the diaphragms 821 and 822 the respective pressure receiving areas $S_1$ and $S_2$ of which are in such a relation as $S_1 > S_2$, a pressure change of the fuel supplied to the inlet of the electromagnetic valve 7 may be increased in accordance with the difference between the areas of the diaphragms 821 and 822. In FIG. 6, numeral 86 designates a bypass outlet which bypasses the fuel supplied from the fuel pump 6 through a fuel inlet 85 to the fuel reservoir 5. The amount of fuel which is to be bypassed through the bypass outlet 86 is regulated by the needle valve 81. The diaphragms 821 and 822 are spaced from each other by a predetermined value. Numeral 88 designates an atmosphere inlet which introduces the atmospheric pressure into an atmospheric pressure chamber 82*c* provided between the fuel chamber 82*a* and the vacuum chamber 82*b*. The intake vacuum pressure $P_I$ is supplied through an inlet 87 to vacuum chamber 82*b*. Assuming that the area of the diaphragm 821 is $\gamma$ times larger than that of the diaphragm 822, the change of the fuel pressure is $\gamma$ times larger than that of the intake manifold pressure $P_I$. This modified pressure regulator 8 is effective to decrease the required range of change in the opening interval of time of the electromagnetic valve 7.

The present invention is not limited to the embodiments described hereinabove but may be modified without departing from the spirit of the invention. As one of modifications, the electromagnetic valve which intermittently meters the fuel may be energized at a constant frequency when the rotation speed of the engine is high.

What we claim is:

1. In combination with an internal combustion engine having a plurality of cylinders, a throttle valve and an output shaft rotated by the combustions of air-fuel mixture supplied to said cylinders, a fuel injection system comprising:

a source of fuel;

means for pressurizing fuel from said source to provide pressurized fuel;

an electromagnetic valve having an inlet for receiving said pressurized fuel and an outlet for supplying fuel to said engine upstream of said throttle valve at a position where substantially atmospheric pressure is always present regardless of the engine intake pressure at a position downstream of said throttle valve, said fuel being supplied to said engine whenever said valve is actuated;

a pressure regulator for regulating the pressure of said pressurized fuel to the inlet of said electromagnetic valve as a function of the engine intake pressure present at a position downstream of said throttle valve, said pressure regulator comprising:

a vacuum chamber communicated with said position downstream of said throttle valve;

an atmosphere chamber communicated with the atmosphere;

a fuel chamber communicated with said pressurized fuel;

a first diaphragm separating said atmosphere chamber from said vacuum chamber;

a second diaphragm separating said atmosphere chamber from said fuel chamber, said second diaphragm being continuously linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring disposed in said vacuum chamber for biasing said first diaphragm such that said valve moved by said first diaphragm through said second diaphragm is prevented from returning said pressurized fuel to said source of fuel; and an electric control circuit for actuating said electromagnetic valve intermittently and synchronously with the suction strokes of said cylinders, each such actuation being for an interval of time proportional to either (a) $\sqrt{P_I}$ or (b) $\sqrt{Qa/N}$, where $P_I$ is the engine intake pressure at a position downstream of the throttle valve, Qa is an amount of air taken into the engine and N is the rotational speed of the engine, whereby the pressurized fuel is metered by said electromagnetic valve.

2. A fuel metering system for use with an internal combustion engine having a throttle valve, said fuel metering system comprising:

a source of fuel;

means for pressurizing fuel from said source to provide pressurized fuel;

a fuel valve having an inlet coupled to said pressurized fuel and an outlet for supplying fuel upstream of said throttle valve at a position having a substantially atmospheric pressure whenever said fuel valve is actuated;

means for regulating the pressure of said pressurized fuel as a function of the engine intake pressure at a position downstream of said throttle valve, said regulating means comprising:

a vacuum chamber communicated with said position downstream of said throttle valve;

an atmosphere chamber communicated with the atmosphere;

a fuel chamber communicated with said pressurized fuel;

a first diaphragm separating said atmosphere chamber from said vacuum chamber;

a second diaphragm separating said atmosphere chamber from said fuel chamber, said second diaphragm being continuously linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring disposed in said vacuum chamber for biasing said first diaphragm such that said valve moved by said first diaphragm through said second diaphragm is prevented from returning said pressurized fuel to said source of fuel; and means for actuating said fuel valve synchronously with the suction strokes of said engine for an interval of time proportional to either (a) $\sqrt{P_I}$ or (b) $\sqrt{Qa/N}$, where $P_I$ is the engine intake pressure at a position downstream of the throttle valve, Qa is an amount of air taken into the engine and N is the rotational speed of the engine.

3. In combination with an internal combustion engine having a plurality of cylinders, a throttle valve and an output shaft rotated by the combustions of air-fuel mixture supplied to said cylinders, a fuel injection system comprising:

a source of fuel;

means for pressurizing fuel from said source to provide pressurized fuel;

an electromagnetic valve for supplying fuel to at least two of said cylinders, said valve having an inlet for receiving said pressurized fuel and an outlet for supplying fuel to said engine upstream of said throttle valve at a position where substantially atmospheric pressure is always present regardless of the engine intake pressure at a position downstream of said throttle valve, said fuel being supplied to said engine whenever said valve is actuated;

a pressure regulator for regulating the pressure of said pressurized fuel to the inlet of said electromagnetic valve as a continuous function of the engine intake pressure present at a position downstream of said throttle valve such that for any incremental change of intake pressure there is a corresponding change in fuel pressure; and an electric control circuit for actuating said electromagnetic valve intermittently and synchronously with the suction strokes of said cylinders, whereby the pressurized fuel is metered by said electromagnetic valve.

4. A fuel injection system according to claim 3 further comprising:

a venturi provided upstream of said throttle valve; and a fuel nozzle communicating the outlet of said electromagnetic valve with said venturi for injection fuel metered by said electromagnetic valve at said venturi.

5. A fuel injection system according to claim 3, wherein said pressure regulator comprises:

a vacuum chamber communicated with said position downstream of said throttle valve;

an atmosphere chamber communicated with the atmosphere;

a fuel chamber communicated with said pressurized fuel;

a first diaphragm separating said atmosphere chamber from said vacuum chamber;

a second diaphragm separating said atmosphere chamber from said fuel chamber, said second diaphragm being linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring in said vacuum chamber for biasing said first diaphragm such that said valve moved by said first diaphragm through said second diaphragm is prevented from returning said pressurized fuel to said source of fuel.

6. A fuel injection system according to claim 3 wherein said pressure regulator comprises:

a fuel chamber communicating with said pressurized fuel;

a vacuum chamber communicating with said downstream position;

a diaphragm separating said fuel chamber from said vacuum chamber;

a regulator valve for controlling the amount of fuel flowing from said fuel chamber into said source of fuel, said regulator valve being mechanically coupled to said diaphragm so that displacement of said diaphragm resulting from a change of the pressure difference between said fuel chamber and said vacuum chamber displaces said regulator valve; and means for biasing said regulator valve closed so as to prevent fuel from flowing from said fuel chamber to said source of fuel when the pressure within said vacuum chamber is substantially atmospheric, whereby as the pressure at said downstream position drips below atmospheric pressure, said fuel valve opens in an amount related to the pressure at said downstream position allowing fuel to flow from said fuel chamber to said source of fuel, dropping the pressure of said pressurized fuel.

7. A fuel injection system according to claim 3 wherein said electric control circuit comprises means for determining the interval of time for each actuation as a function of the temperature of said engine, the amount of air flow into said engine and the oxygen content of the exhaust gases from said engine.

8. A fuel injection system according to claim 4, wherein said pressure regulator comprises:

a vacuum chamber communicated with said position downstream of said throttle valve;

an atmosphere chamber communicated with the atmosphere;

a fuel chamber communicated with said pressurized fuel;

a first diaphragm separating said atmosphere chamber from said vacuum chamber;

a second diaphragm separating said atmosphere chamber from said fuel chamber, said second diaphragm being linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring disposed in said vacuum chamber for biasing said first diaphragm such that said valve moved by said first diaphragm through said second diaphragm is prevented from returning said pressurized fuel to said source of fuel.

9. A fuel injection system according to claim 4 wherein said pressure regulator comprises:

a fuel chamber communicating with said pressurized fuel;

a vacuum chamber communicating with said downstream position;

a diaphragm separating said fuel chamber from said vacuum chamber;

a regulator valve for controlling the amount of fuel flowing from said fuel chamber into said source of fuel, said regulator valve being mechanically coupled to said diaphragm so that displacement of said diaphragm resulting from a change of the pressure difference between said fuel chamber and said vacuum chamber displaces said regulator valve; and means for biasing said regulator valve closed so as to prevent fuel from flowing from said fuel chamber to said source of fuel when the pressure within said vacuum chamber is substantially atmospheric, whereby as the pressure at said downstream position drops below atmospheric pressure, said fuel valve opens in an amount related to the pressure at said downstream position allowing fuel to flow from said fuel chamber to said source of fuel, dropping the pressure of said pressurized fuel.

10. A fuel injection system according to claim 4 wherein said electric control circuit comprises means for determining the interval of time for each actuation as a function of the temperature of said engine, the amount of air flow into said engine and the oxygen content of the exhaust gases from said engine.

11. A fuel metering system for use with an internal combustion engine having a throttle valve and a plurality of cylinders, said fuel metering system comprising:

a source of fuel;

means for pressurizing fuel from said source to provide pressurized fuel;

a fuel valve for supplying fuel to at least two of said cylinders, said valve having an inlet for receiving said pressurized fuel and an outlet for supplying fuel upstream of said throttle valve at a position having a substantially atmospheric pressure whenever said fuel valve is actuated;

means for regulating the pressure of said pressurized fuel as a continuous function of the engine intake pressure at a position downstream of said throttle valve such that for any incremental change of intake pressure there is a corresponding change in fuel pressure; and means for actuating said fuel valve synchronously with the suction strokes of said engine for an interval of time proportional to either (a) $\sqrt{P_I}$ or $\sqrt{Qa/N}$, where $P_I$ is the engine intake pressure at a position downstream of the throttle valve, Qa is an amount of air taken into the engine and N is the rotational speed of the engine.

12. A fuel metering system according to claim 11 further comprising:

a venturi provided upstream of said throttle valve; and a fuel nozzle communicating the outlet of said electromagnetic valve with said venturi for injecting fuel metered by said electromagnetic valve at said venturi.

13. A fuel metering system according to claim 11 wherein said means for regulating comprises:

a fuel chamber communicating with said pressurized fuel;

a vacuum chamber communicating with said downstream position;

a diaphragm separating said fuel chamber from said vacuum chamber;

a regulator valve for controlling the amount of fuel flowing from said fuel chamber into said source of fuel, said regulator valve being mechanically coupled to said diaphragm so that displacement of said diaphragm resulting from a change of the pressure difference between said fuel chamber and said vacuum chamber displaces said regulator valve; and means for biasing said regulator valve closed so as to prevent fuel from flowing from said fuel chamber to said source of fuel when the pressure within said vacuum chamber is substantially atmospheric, whereby as the pressure at said downstream position drops below atmospheric pressure, said fuel valve opens in an amount related to the pressure at said downstream position allowing fuel to flow from said fuel chamber to said source of fuel, dropping the pressure of said pressurized fuel.

14. A fuel metering system according to claim 11 wherein said means for regulating comprises:

a vacuum chamber communicated with said position downstream of said throttle valve;

an atmosphere chamber communicated with the atmosphere;

a fuel chamber communicated with said fuel;

a first diaphragm separating said atmosphere chamber from said vacuum chamber;

a second diaphragm separating said atmosphere chamber from said fuel chamber, said second diaphgram being linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring disposed in said vacuum chamber for biasing said first diaphragm such that said valve moved by said first diaphragm through said second diaphragm is prevented from returning said pressurized fuel to said source of fuel.

15. A fuel metering system according to claim 11 wherein said means for actuating said fuel valve comprises means for determining the interval of time for each actuation as a function of the temperature of said engine, the amount of air flow into said engine and the oxygen content of the exhaust gases from said engine.

16. A fuel metering system according to claim 12 wherein said means for regulating comprises:

a fuel chamber communicating with said pressurized fuel;

a vacuum chamber communicating with said downstream position;

a diaphragm separating said fuel chamber from said vacuum chamber;

a regulator valve for controlling the amount of fuel flowing from said fuel chamber into said source of fuel, said regulator valve being mechanically coupled to said diaphragm so that displacement of said diaphragm resulting from a change of the pressure difference between said fuel chamber and said vacuum chamber displaces said regulator valve; and means for biasing said regulator valve closed so as to prevent fuel from flowing from said fuel chamber to said source of fuel when the pressure within said vacuum chamber is substantially atmospheric, whereby as the pressure at said downstream position drops below atmospheric pressure, said fuel valve opens in an amount related to the pressure at said downstream position allowing fuel to flow from said fuel chamber to said source of fuel, dropping the pressure of said pressurized fuel.

17. A fuel metering system according to claim 12 wherein said means for regulating comprises:

a vacuum chamber communicated with said position downstream of said throttle valve;

an atmosphere chamber communicated with the atmosphere;

a fuel chamber communicated with said fuel;

a first diaphragm separating said atmosphere chamber from said vacuum chamber;

a second diaphragm separating said atmosphere chamber from said fuel chamber, said second diaphgram being linked with said first diaphragm so as to be moved therewith and having a pressure receiving area smaller than that of said first diaphragm;

a valve associated with said second diaphragm for controlling the return of pressurized fuel from said fuel chamber to said source of fuel to thereby regulate the pressure of said pressurized fuel; and a spring disposed in said vacuum chamber for biasing said first diaphragm such that said valve moved by said first diaphragm through said second diaphragm is prevented from returning said pressurized fuel to said source of fuel.

18. A fuel metering system according to claim 12 wherein said means for actuating said fuel valve comprises means for determining the interval of time for each actuation as a function of the temperature of said engine, the amount of air flow into said engine and the oxygen content of the exhaust gases from said engine.

19. A combination according to claim 3 wherein said electric control circuit is arranged to actuate said electromagnetic valve such that each actuation is for an interval of time proportional to either (a) $\sqrt{P_I}$ of (b) $\sqrt{Qa/N}$, where $P_I$ is the engine intake pressure at a position downstream of the throttle valve, Qa is an amount of air taken into the engine and N is the rotational speed of the engine.

* * * * *